US007819547B1

(12) United States Patent
Teetzel et al.

(10) Patent No.: US 7,819,547 B1
(45) Date of Patent: Oct. 26, 2010

(54) END CAP SWITCH FOR FLASHLIGHT

(75) Inventors: James W. Teetzel, York, ME (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 74 days.

(21) Appl. No.: 12/131,517

(22) Filed: Jun. 2, 2008

Related U.S. Application Data

(60) Provisional application No. 60/932,694, filed on Jun. 1, 2007.

(51) Int. Cl.
*F21L 4/00* (2006.01)
*F21G 1/34* (2006.01)

(52) U.S. Cl. ..... 362/206; 362/110

(58) Field of Classification Search ..... 362/110, 362/113, 114, 205, 206; 200/60
See application file for complete search history.

(56) References Cited

U.S. PATENT DOCUMENTS 4,876,816 A * 10/1989 Triplett ..... 42/115
6,307,328 B1 * 10/2001 Ko et al. ..... 315/200 R
6,650,066 B2 * 11/2003 Bruwer ..... 315/200 A
7,434,956 B2 * 10/2008 Mattheis ..... 362/205
7,609,005 B2 * 10/2009 West ..... 315/200 A
7,735,255 B1 * 6/2010 Kincaid et al. ..... 42/146
7,736,013 B2 * 6/2010 Griffin ..... 362/110
2008/0049433 A1 * 2/2008 Sharrah et al. ..... 362/362

* cited by examiner

*Primary Examiner*—Stephen F. Husar
*Assistant Examiner*—Peggy A. Neils
(74) *Attorney, Agent, or Firm*—McLane, Graf, Raulerson & Middleton, Professional Association

(57) ABSTRACT

A switch apparatus for a flashlight includes a housing adapted to attach to a flashlight and defining an interior cavity. A processor is coupled to a first switch and a second switch. The first switch is user actuable and coupled to an input of said processor. The second switch is housed within said interior cavity and coupled to an output of the processor and is an electronically-controlled switch operable to selectively actuate the flashlight in response to actuation of said first switch. In a further aspect, a flashlight apparatus includes the switch apparatus and a flashlight.

13 Claims, 4 Drawing Sheets

END CAP SWITCH FOR FLASHLIGHT

CROSS REFERENCE TO RELATED APPLICATIONS

This application the priority benefit under 35 U.S.C. §119 (e) based on U.S. provisional application Ser. No. 60/932,694 filed Jun. 1, 2007. The aforementioned provisional application is incorporated herein by reference in its entirety.

BACKGROUND

The present disclosure relates to an end cap switch for a flashlight. Weapon-mounted tactical flashlights are generally known, e.g., to provide illumination of an intended target in low light conditions. The present disclosure allows a conventional flashlight to be mounted on a weapon and provides an actuation switch that can be conveniently positioned for operation by a marksman.

SUMMARY

A switch apparatus for a flashlight includes a housing adapted to attach to a flashlight and defining an interior cavity and a processor coupled to a first switch and a second switch. The first switch is user actuable and is coupled to an input of the processor. The second switch is housed within the interior cavity and is coupled to an output of the processor. The second switch is an electronically-controlled switch operable to selectively actuate the flashlight in response to actuation of the first switch. In a further aspect, a flashlight apparatus includes the switch apparatus and a flashlight.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
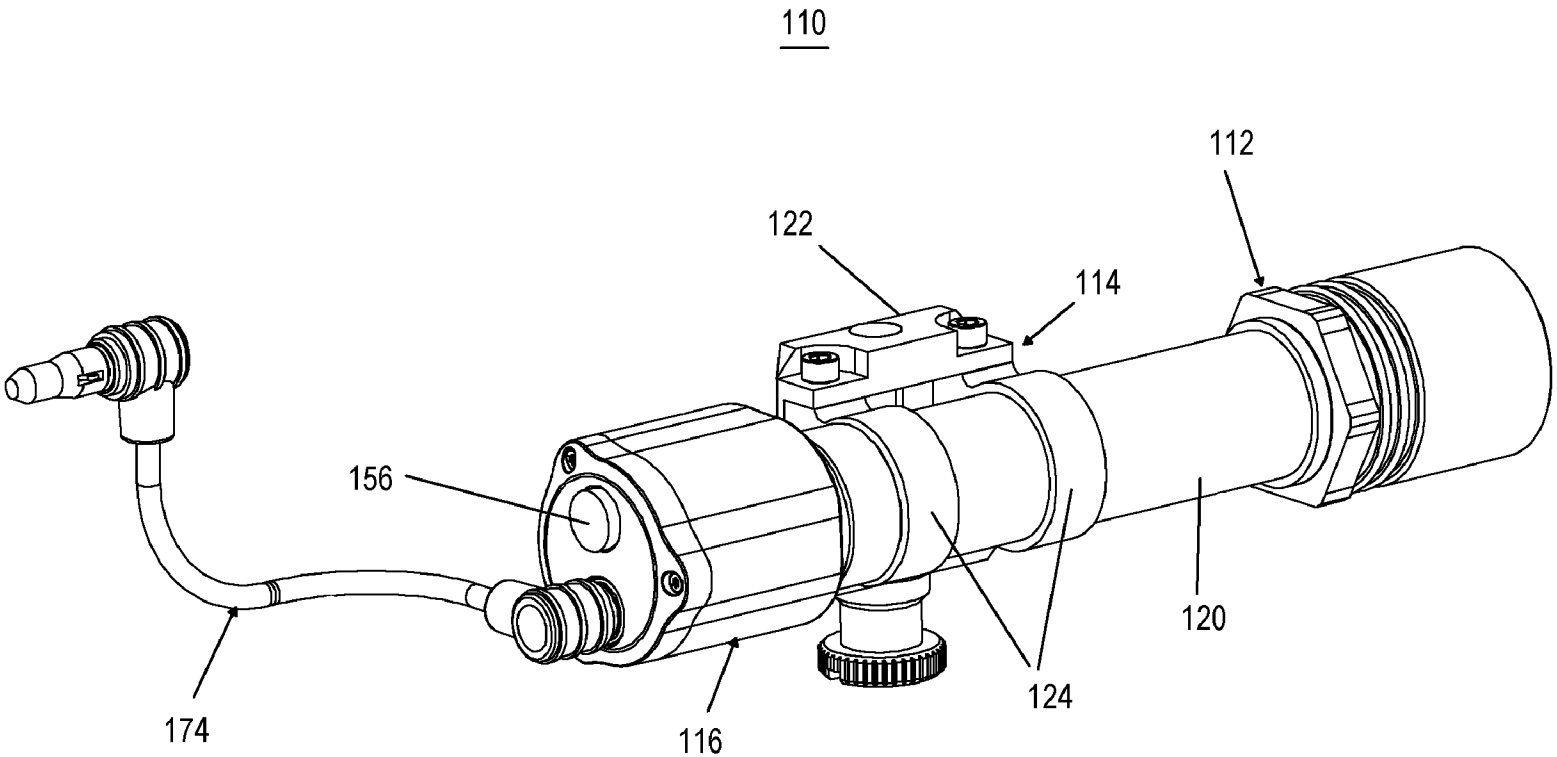
FIG. 1 is a pictorial view of end cap switch attached to the end of a flashlight.
Figure 3:
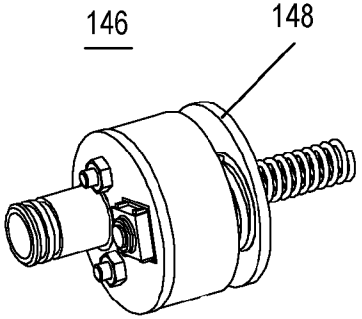
FIG. 3 is a pictorial view of the end cap circuit subassembly.
Figure 4:
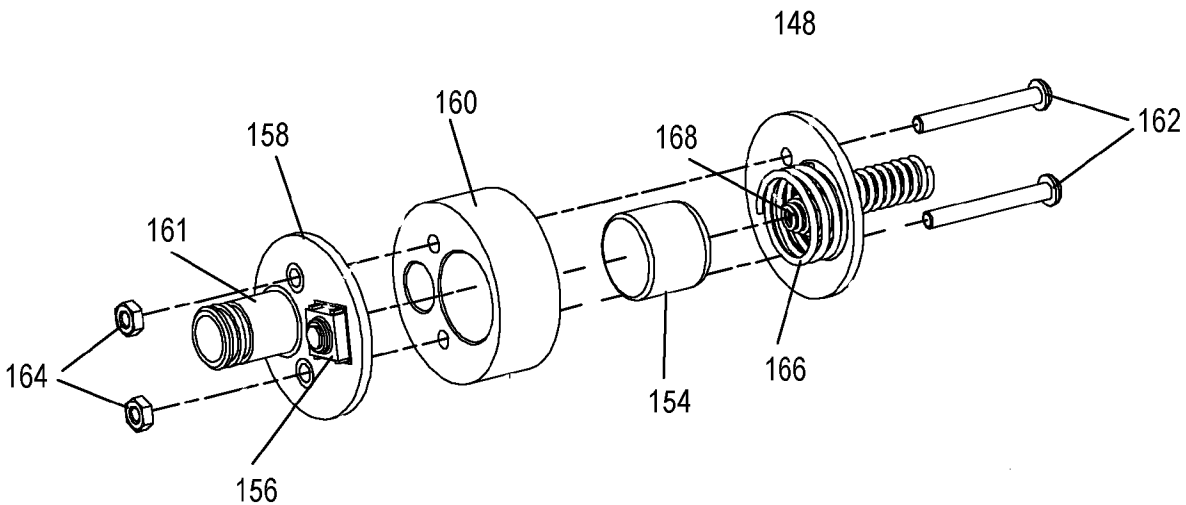
FIG. 4 is an exploded view of the end cap circuit subassembly appearing in FIG. 3.
Figure 5:
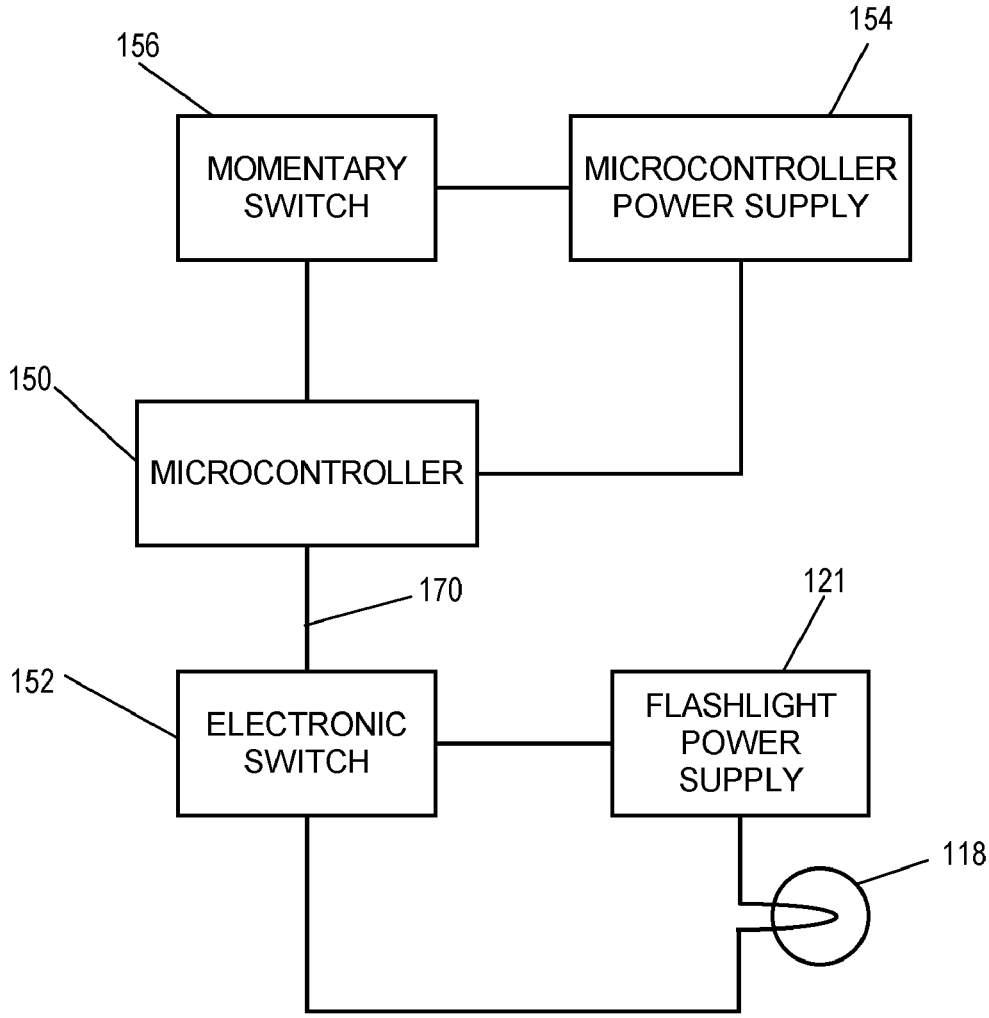
FIG. 5 is a functional block diagram of the electrical components.

Referring now to the drawing FIGS. 1-5, wherein like reference numerals refer to like components throughout the several views, there appears an exemplary flashlight apparatus 110, which includes a flashlight 112, a weapon mount assembly 114, and an end cap switch assembly 116. As best seen in FIGS. 1 and 5, the flashlight 112 may be a conventional flashlight having an illumination element 118 (e.g., incandescent, halogen, LED, etc.) and a body 120 housing one or more batteries 121 as a source of electrical power. The apparatus will be described herein by way of reference to the depicted embodiment 110 wherein the flashlight 112 is of a type having a generally elongate and tubular body 120 having a removable end cap. The body 120 may be formed of a conductive material which forms a part of the illumination circuit, or may include a conductive portion or component therefor. However, it will be recognized that the present development can be adapted for all manner of flashlight sizes, shapes, and designs.

The weapon mount assembly 114 includes a mounting base 122 which is removably attachable to a firearm and one or more bands or clamping elements 124 for removably securing the flashlight to the base 122. In the depicted preferred embodiment the mounting base 122 is of a type adapted to be selectively positioned on a Picatinny rail interface (e.g., as specified in MIL-STD-1913). However, it will be recognized that the mounting base 122 may be adapted for use with all manner firearms, including without limitation rifles, handguns, machine guns, mortars, etc., and that the mounting system may be modified to accommodate other rail interface systems or weapon accessory mounting systems.

Figure 2:
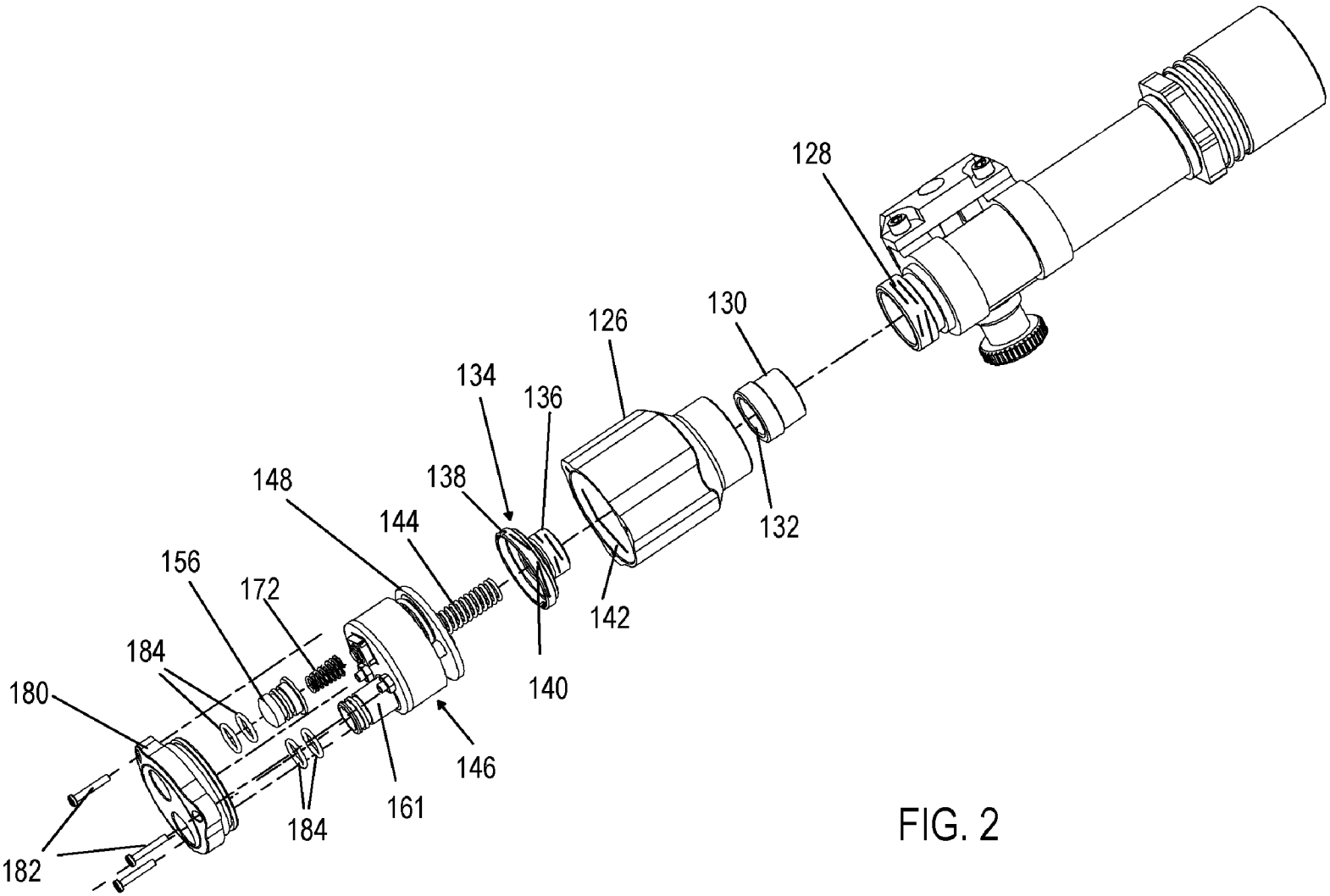
FIG. 2 is an exploded view of the device appearing in FIG. 1.

The end cap assembly 116 is best seen in FIG. 2 and includes an external housing 126 and is adapted to replace a pre-existing, removable end cap (not shown) of the flashlight 112. Commonly, such end caps are removable to allow access to the battery compartment for battery replacement and include a terminal or contact for the battery or batteries and constitute, along with a metallic or conductive housing, a portion of the conductive pathway between the flashlight power source 121 and the illumination element 118.

The end cap assembly 116 is adapted for removable attachment to the flashlight body 120 in the same manner as the pre-existing end cap that it replaces, and may be a threaded connection wherein internal helical threads (not shown) in the end cap housing 126 engage complimentary external helical threads 128 on the flashlight body 120. In this manner, the present development can be adapted for use with commercially available flashlights including, without limitation, flashlights available from SureFire, LLC, of Fountain Valley, Calif., and Mag Instrument, Inc., of Ontario, Calif., among others.

An insulator sleeve 130 is received within the forward facing (in the operable position) end of the housing 126 and includes internal threads 132. A contact ring 134 formed of brass or other conductive material includes a narrow male threaded portion 136 and a flange portion 138. The enlarged diameter flange portion 138 includes external threads 140. The threads 140 engage internal threads 142 within the rearward end of the end cap housing 126. The male threads 136 engage the threads 132 of the insulator 130 to capture an inward flange (not shown) in the end cap housing 126.

An axially-extending spring 144 passes through the contact ring 134 and insulator sleeve 130 and the distal end of the spring 144 contacts the negative terminal of the battery or batteries 121, not shown in FIGS. 1-4. The insulator ring 130 keeps the spring centered and prevents the spring 144 from shorting out against the side of the side of the flashlight body 120. The proximal end of the spring 144 is coupled to a first, main circuit board 148 of a circuit board subassembly 146.

As best seen in FIGS. 3, 4 and 5, the circuit board subassembly 146 includes the first circuit board 148 which includes a processor 150, such as microcontroller, microprocessor, application-specific integrated circuit (ASIC), or the like and an electronically controlled switch 152 for actuating the flashlight 112 as detailed below. A battery 154 provides power to operate the processor 150 and is preferably a long-life lithium battery. The battery 154 is electrically coupled to a momentary contact switch 156 on a second circuit board 158.

The battery 154 is carried within a battery spacer/insulator 160 between the circuit boards 148 and 158. A remote connector receptacle 161 provides terminals for electrically coupling a remotely located switch. Conductive screws 162 and nuts 164 (e.g., which may formed of brass) carry current between the first and second circuit boards 148 and 158. A positive contact spring 166 and a ground contact spring 168 on the first circuit board 148 contact the positive and negative terminals of the processor power supply 154 and are electrically coupled to the processor 150.

The momentary switch 156 may be a normally open switch which closes when depressed by the user to provide a signal to the processor 150. Control logic in the processor 150 allows the switch 156 to selectively operate the flashlight momentarily or in continuously-on operation.

In operation, if the user desires to use the switch 156 as a momentary on switch, the user simply depresses the switch 156 when it is desired to actuate the flashlight 112 and releases the switch 156 when it is desired to deactuate the flashlight. The processor 150 monitors the state of the switch 156. When the processor 150 receives the signal from the momentary switch 156, the processor 150 triggers the electronically controlled switch 152. The switch 152 is preferably semiconductor switch and more preferably a FET or MOSFET switch. For example, in the case of a FET or MOSFET switch, when the momentary switch 156 is in the closed state, a voltage is applied to an output line 170 of the processor 150 which is connected to the control input or gate of the electronically controlled switch 152 and current in the main flashlight circuit is allowed to flow, thereby actuating the flashlight 112.

When the switch 156 is released, a return spring 172 returns the switch 156 to the open position. When the processor detects that the switch 156 is open, the processor 150 again triggers the electronically controlled switch 152 to deactuate the flashlight 112. Again, in the case of a FET or MOSFET switch, the voltage at the processor output line 170 is removed and current in the main flashlight circuit is switched off.

Control logic in the processor 150 also allows the flashlight to be turned continuously on in response to a "double tap" of the switch 156 (or some other sequence). In operation, if the user desires to turn the flashlight on continuously the user simply depresses the switch 156 twice in succession (or, if desired, according to another preprogrammed sequence). When the processor 150 receives the "double tap" signal from the momentary switch 156, the processor 150 triggers the electronically controlled switch to actuate the flashlight 112, which remains on when the switch is released. When the user desires to deactivate the flashlight when it is in continuous on mode, the user again actuates the switch 156.

Additionally or alternatively, a remote connector cable 174 may be employed to provide an electrical connection between the remote connector receptacle 161 on the switch circuit board 158 and a remotely located switch, such as a switch provided on a hand grip or other weapon-mounted accessory or module. Such remotely located switch may then be used in the same manner as the switch 156.

A rear housing cover plate 180 is secured to the housing 126 via threaded fasteners 182. A sealing ring or gasket may be provided to create a sealing interference therebetween. The switch 156 and the remote connector 161 extend through openings in the housing cover plate 180. Sealing rings or gaskets 184 may be provided to create a seal against moisture or other contamination.

The invention has been described with reference to the preferred embodiments. Modifications and alterations will occur to others upon a reading and understanding of the preceding detailed description. Therefore, it is not desired to limit the invention to the specific examples disclosed or the exact construction and operation shown and described. Rather, all suitable modifications and equivalents may be resorted to, falling within the scope of the invention.

Having thus described the preferred embodiments, the invention is now claimed to be:

1. A switch apparatus for a flashlight, comprising:
- a housing adapted for removable attachment to a flashlight;
- a processor coupled to a first switch and a second switch, said processor, said first switch, and said second switch received within said housing;
- said first switch being user actuable and coupled to an input of said processor;
- said second switch coupled to an output of said processor, said second switch being an electronically-controlled switch operable to selectively actuate the flashlight; and
- said second switch selectively actuating the flashlight in response to actuation of said first switch.

2. The switch apparatus of claim 1, wherein said first switch is a push button switch.

3. The switch apparatus of claim 1, wherein said first switch is a normally open, momentary contact switch.

4. The switch apparatus of claim 1, wherein said second switch is a semiconductor device.

5. The switch apparatus of claim 4, wherein said second switch is selected from the group consisting of a transistor, a field effect transistor, and a metal oxide semiconductor field effect transistor.

6. The switch apparatus of claim 1, wherein said processor includes control logic for controlling said second switch to actuate the flashlight when said first switch is actuated and to deactuate the flashlight when said first switch is deactuated.

7. The switch apparatus of claim 1, wherein said processor includes control logic for controlling said second switch to allow operation of the flashlight in a continuously on mode of operation in response to a predetermined actuation sequence of the first switch.

8. The switch apparatus of claim 7, wherein the first switch is a push button switch and said predetermined sequence is input by actuating said first switch twice in rapid succession.

9. The switch apparatus of claim 1, wherein the flashlight includes a mounting member for removably attaching the flashlight to a firearm.

10. A flashlight apparatus, comprising a flashlight and a switch apparatus removably attachable to said flashlight, said switch apparatus comprising:
- a housing adapted for removable attachment to a flashlight;
- a processor coupled to a first switch and a second switch, said processor, said first switch, and said second switch received within said housing;
- said first switch being user actuable and coupled to an input of said processor;
- said second switch coupled to an output of said processor, said second switch being an electronically-controlled switch operable to selectively actuate said flashlight; and
- said second switch selectively actuating said flashlight in response to actuation of said first switch.

11. The flashlight apparatus of claim 10, wherein said housing is interchangeable with a battery compartment cover of said flashlight.

12. The switch apparatus of claim 1, further comprising:
- a power supply received within said housing and electrically coupled to said first switch and said processor.

13. The switch apparatus of claim 1, wherein said housing is interchangeable with a battery compartment cover of the flashlight.

* * * * *